United States Patent [19]

Claassen

[11] Patent Number: 4,741,414

[45] Date of Patent: May 3, 1988

[54] LIFT APPARATUS FOR PALLETS

[76] Inventor: Robert D. Claassen, 12015 SW. Karol Ct., Tigard, Oreg. 97223

[21] Appl. No.: 25,368

[22] Filed: Mar. 13, 1987

[51] Int. Cl.[4] ..... B66F 7/08

[52] U.S. Cl. ..... 187/18; 414/608; 312/312; 254/122; 254/124

[58] Field of Search ..... 254/1, 2 C, 45, 88, 254/122, 124, 91; 414/495, 498, 608; 187/1 R, 18; 211/191; 248/276; 108/51.1; 312/312; 182/141

[56] References Cited

U.S. PATENT DOCUMENTS

| | | | |
|---|---|---|---|
| 2,536,954 | 1/1951 | Olsen | 254/91 |
| 3,239,294 | 3/1966 | Lammeyer | 254/122 |
| 3,935,600 | 2/1976 | Scribner | 187/18 |
| 4,261,079 | 4/1981 | Masini et al. | 187/18 |

FOREIGN PATENT DOCUMENTS

| | | | |
|---|---|---|---|
| 3325036 | 1/1985 | Fed. Rep. of Germany | 187/18 |

*Primary Examiner*—Frederick R. Schmidt
*Assistant Examiner*—Judy J. Hartman
*Attorney, Agent, or Firm*—Chernoff, Vilhauer, McClung & Stenzel

[57] ABSTRACT

A pallet lift apparatus includes a substantially U-shaped enclosure having inner and outer walls and a lift cradle suspended inside the enclosure for supporting a wooden pallet or other loading platform. The cradle may be moved to a convenient vertical height by a hydraulic scissor lift for loading so that workers may stack the pallet without the bending and stooping that frequently causes low back pain.

8 Claims, 3 Drawing Sheets

LIFT APPARATUS FOR PALLETS

BACKGROUND OF THE INVENTION

The following invention relates to a lift apparatus which raises pallets to a convenient height for loading so that lower back strain may be avoided.

Wooden pallets are frequently used to transport goods within warehouses, or between trucks or loading vans in a warehouse, because of their adaptability to many different types of lifting machines. For example, forklifts or pallet jacks are commonly used to engage pallets which are loaded with goods and move them from one location to another. Wooden pallets that are commonly used for this purpose are box-like platforms with upper and lower surfaces and a hollow area in between for engagement by the forklift or pallet jack.

The top surface of the pallet rests about 6 inches above the floor, and thus the loading of the pallet must be done manually by stacking the goods at this level. This stacking operation requires that workers bend over from the waist to lift the goods and stack them on top of the pallet. The constant stooping or bending required, and the accompanying lifting of heavy loads, places considerable strain on the muscles of the lower back. Prolonged work with heavy materials in this position will eventually lead to back strain or chronic low back pain.

Another problem which is common in the loading of pallets, especially when the goods comprise circulars, advertising materials or other stacks of paper materials, is that the materials have a tendency to slide off the edges of the pallet as they are stacked. Care must therefore be taken to stack the materials directly one on top of the other to avoid spilling off of the side of the pallet.

Currently, fully automatic palletizers are available which eliminate the need for manual labor but which are excessively priced. Also, these automatic pallatizers handle only certain types of goods or materials.

Scissor lifts are also available. These devices comprise a platform raised and lowered by an exposed scissors assembly situated on opposite sides of the platform. These lifts have three primary problems associated with them. First, a scissors lift has an exposed scissors mechanism which can be dangerous. Second a scissors lift can be moved from place to place only with a fork lift because there is no means by which the device may be engaged by a simpler device such as a pallet jack. Finally, scissor lifts, in their lowest position, hold the pallets 4 to 6 inches above the floor which is too high for the pallets to be engaged by a pallet jack. Therefore, more expensive fork lifts must be used.

SUMMARY OF THE INVENTION

The invention comprises a lift apparatus for pallets which facilitates the loading and unloading thereof and includes a U-shaped enclosure having a rear portion and two adjacent side portions and a selectively movable lift cradle situated within the enclosure for holding a loading platform such as a pallet. A lift actuating device vertically moves the lift cradle up or down so that the loading platform may be positioned at a convenient height for loading and unloading. Thus the pallet may be positioned at approximately waist level so that materials may be stacked on the pallet without the need for the constant bending and stooping that has heretofore been necessary in order to load the pallet.

The walls of the enclosure may be made sufficiently high so that when the pallet is placed at a convenient height, enough of the interior wall remains above the top surface of the pallet to serve as a partial container for the stacked materials. As the materials are stacked higher, the lift cradle may be lowered by depressing a switch which actuates a lift mechanism to provide continuous vertical movement in the desired direction until the switch is released. Thus, as each layer of materials is stacked on the pallet, the height may be constantly adjusted so that the new loading surface is maintained at a height which enables the loader to stand upright when stacking materials. Also the apparatus is heavy enough so that a loader may brace himself against its outer walls for leverage when loading materials toward the center of the pallet.

The lift mechanism may include a scissors lift driven by a hydraulic piston and may be enclosed between interior and exterior walls of the enclosure thereby shielding workers from the potential danger of limbs being caught in the mechanism.

The lift cradle is suspended from a carriage bar by four hangers. Thus, the cradle, when lowered, may rest directly on the floor, permitting the pallet to be placed in the lift cradle by manually sliding it or by using a pallet jack to load and unload the cradle.

The apparatus may also include a stop for retaining the lift cradle at a predetermined height so that the apparatus can be raised by exerting upward pressure from underneath the lift cradle. Thus, for example, a pallet can be placed underneath the lift cradle with the stops in place, and the entire lift apparatus can then be carried by means of a pallet jack to a desired location.

It is a primary object of this invention to provide a pallet lift apparatus for enabling the loading and unloading of pallets at a convenient height relative to a workers body so that back strain and low back injuries are avoided.

A further object of this invention is to provide a lifting apparatus for a pallet which enables the pallet to be made up accurately so that materials stacked thereon do not spill when the pallet is transported from one location to another.

A still further object of this invention is to provide a lifting apparatus for pallets in which the lifting mechanism is enclosed to remove the danger of limbs being caught therein.

A still further object of the invention is to provide a pallet lift apparatus which may be easily and efficiently transported from place to place.

Yet a further object of the invention is to provide a pallet lift apparatus which may lower pallets all the way to the floor so that they may be engaged by a conventional pallet jack.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
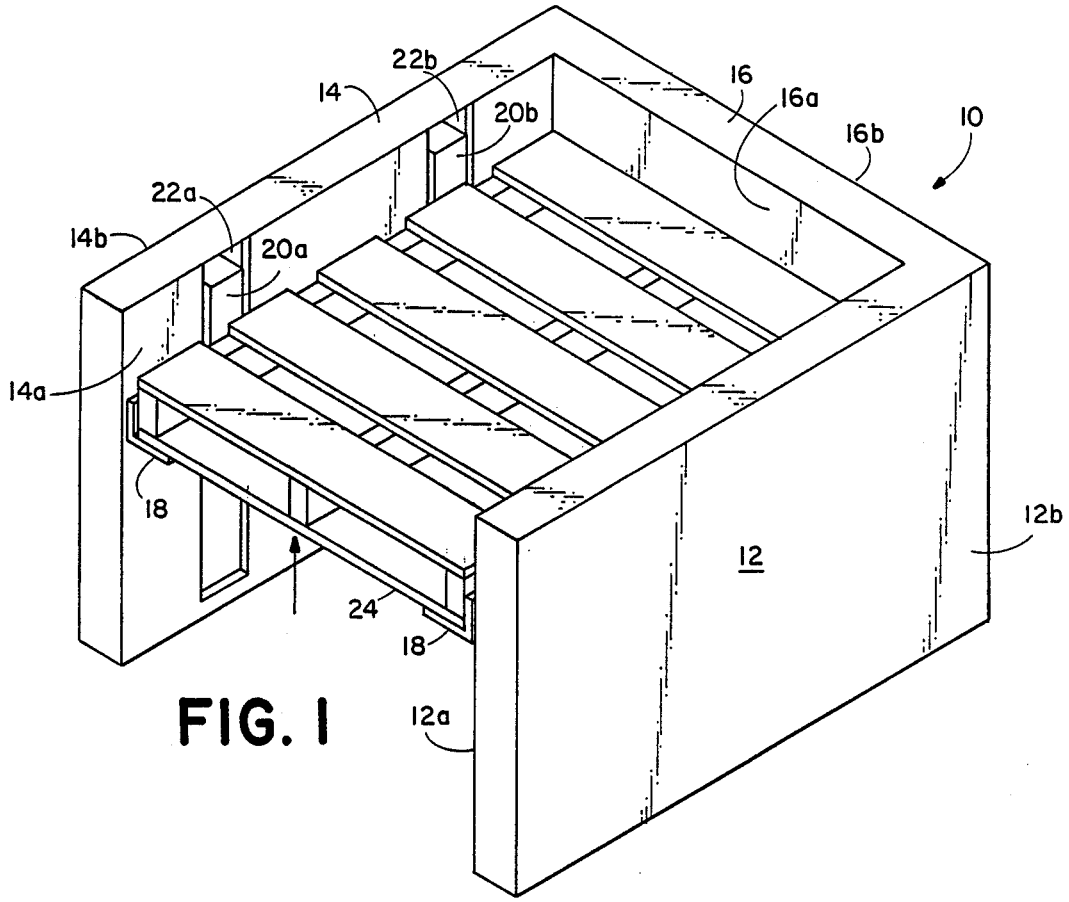
FIG. 1 is a perspective view of a pallet lift apparatus holding a wooden pallet.

A pallet lift apparatus 10 comprises a substantially U-shaped enclosure formed of sidewalls 12 and 14 and rear wall 16. Double-walled construction is used so that the sidewall 12 comprises inner and outer walls 12*a* and 12*b*, respectively, rear wall 16 includes inner and outer walls 16*a* and 16*b*, respectively, and sidewall 14 includes inner and outer walls 14*a* and 14*b*, respectively. By the use of double-walled construction, a lift mechanism may be contained between the inner and outer walls thereof to prevent possible injuries to workers. The lift apparatus 10 includes a lift cradle 18 which is a substantially U-shaped angle bracket suspended by four hangers including hangers 20*a* and 20*b*, which protrude through slots 22*a* and 22*b* in wall 14*a* and hangers 26*a* and 26*b* which protrude through slots 30*a* and 30*b* in inner wall 12*a* (see FIG. 2). A wooden pallet 24 is held by the lift cradle 18 and may be lifted to a height near the top of the apparatus 10 at which there will still remain a portion of inner walls 16*a*, 14*a* and 12*a* to contain materials that may be stacked thereon. The height of the apparatus 10 may be approximately 34 inches so that the height of the top surface of the pallet 24 when held within the lift cradle will be at a height of approximately 32 inches. The height of 32" is an optimum height, sometimes referred to as "knuckle height" in the industry, for this type of operation. This will permit the pallet 24 to be loaded by workers standing upright instead of bending over.

If desired a guard plate (not shown) comprising a hinged 90° bracket may be installed atop sidewalls 12 and 14 to prevent workers from catching fingers in slots 22*a*, 22*b*, 30*a* and 30*b*. The bracket could have a hinge at one end and a limit switch at the other so that any movement of the plate would shut off the lift mechanism.

Figure 2:
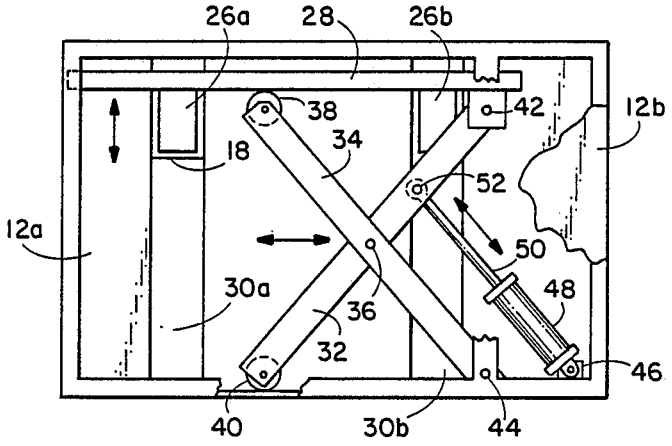
FIG. 2 is a side cutaway view of the pallet lift apparatus of FIG. 1.

The lift mechanism for moving the lift cradle 18 up and down is shown in FIG. 2. The lift cradle 18 is connected to bangers 26*a* and 26*b* which are suspended from a carriage bar 28. The carriage bar 28 is supported by a pair of scissor arms 32 and 34 which are joined by a pin 36. Scissor arm 34 includes a roller 38 which glides underneath carriage bar 28. Scissor arm 32 includes a roller 40 which glides along the floor of the enclosure of sidewall 12. The opposite end of scissor arm 32 is connected to carriage bar 28 by a pin 42, and the lower end of scissor arm 34 is connected by a pin 44 to sidewall 12. Connected to a tab 46 which is situated within the enclosure formed by walls 12*a* and 12*b* is a cylinder 48 which includes a piston 50 connected by a pin 52 to scissor arm 32. As the piston 50 moves in the directions of the slanted arrows shown in FIG. 2, the scissor arms 32 and 34 move in the directions indicated by the horizontal arrows thus causing the carriage bar 28 to move vertically up or down (indicated by the vertical arrows) depending upon whether the piston 50 is extended or contracted. The piston 48 is a hydraulic piston and receives fluid pressure from an electrically operated pump as will be described below.

Figure 3:
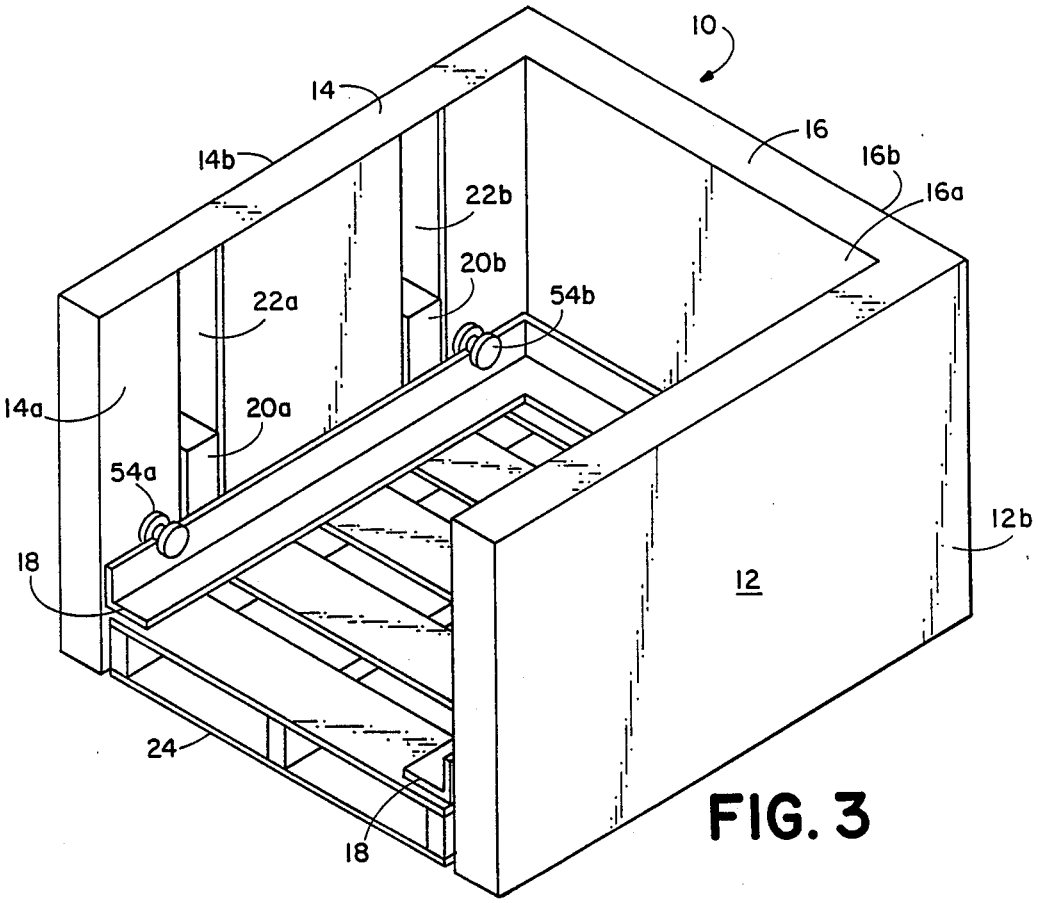
FIG. 3 is a perspective view of the pallet lift apparatus of FIG. 1 with a wooden pallet disposed beneath the lift cradle.
Figure 4:
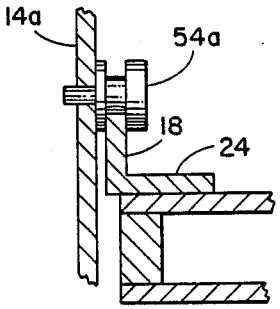
FIG. 4 is a partial front cutaway view of the pallet lift apparatus of FIG. 3.

Another feature of the invention is illustrated in FIG. 3. The pallet lift apparatus 10 is constructed of steel, and as such is too heavy to be moved manually. Heavy construction is an advantage in that a worker may brace himself against the outer walls 12*b*, 16*b* and 14*b* for leverage when loading materials onto pallet 24. Still, provision must be made for moving the lift apparatus 10 from place to place within the work area. To accomplish this, the lift cradle 18 is moved to a position far enough off of the floor to accommodate a wooden pallet 24 which is slid underneath it. The lift cradle 18 is maintained at this height by four steel pins (pins 54*a* and 54*b* are shown. Two other pins on the opposite side are not shown.) The pins are inserted through apertures in the wall as shown more clearly in FIG. 4 which shows pin 54*a* inserted into an aperture in inner wall 14*a*. A pallet jack (not shown) may then engage the pallet 24 in the conventional manner. Lifting the pallet, the pallet jack exerts pressure on the underside of lift cradle 18 thereby allowing the entire apparatus 10 to be lifted and carried from place to place within the work area.

Figure 6:
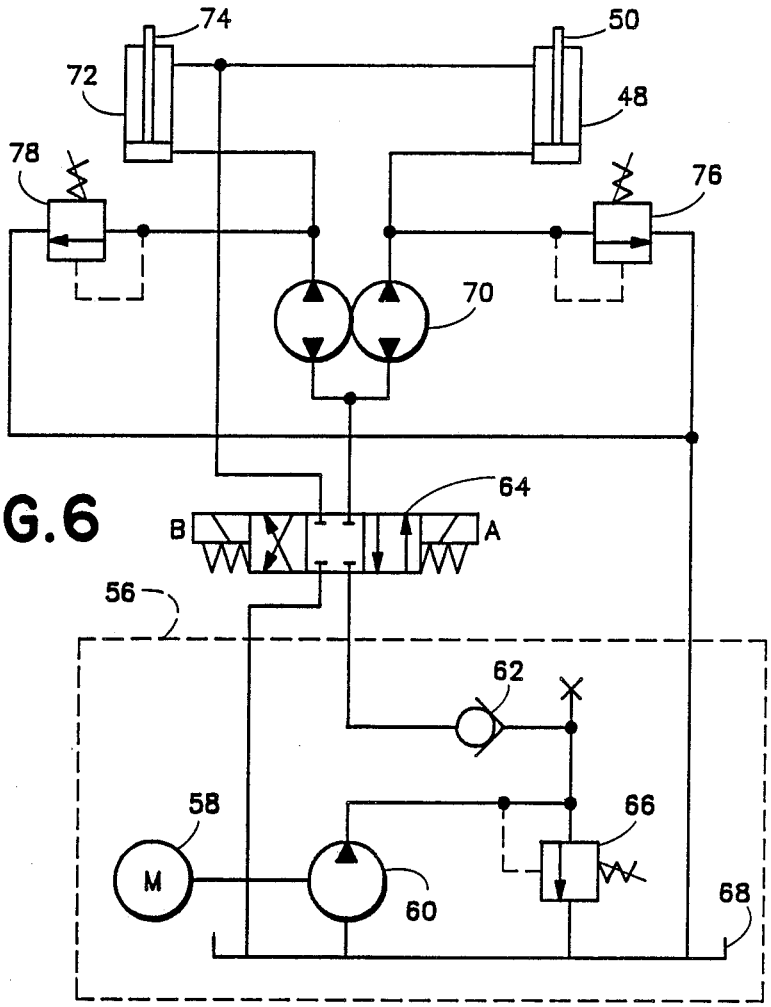
FIG. 6 is a schematic diagram of an electrically powered hydraulic system for actuating the scissors lift shown in FIG. 2.

FIG. 6 shows a schematic diagram of an electrically powered hydraulic system for raising and lowering the scissors lift apparatus shown in FIG. 2. An enclosure 56 contains a motor 58 which drives a pump 60. The output of the pump 60 is connected through a check valve 62 to a three position switch 64 which is actuated by solenoids A and B. The output of pump 60 is also connected to a pressure relief valve 66 which vents into reservoir 68. The output of the three position switch 64 is connected to a flow divider 70 which drives a pair of hydraulic cylinders 48 and 72. Cylinder 48 drives piston 50 which is also shown in FIG. 2. Cylinder 72 drives a piston 74 which is connected to a scissor lift assembly contained within sidewall 14. Cylinder 48 includes a pressure relief valve 76 which is vented to reservoir 68 and cylinder 72 includes a pressure relief valve 78 which is also vented to reservoir 68.

Figure 5:
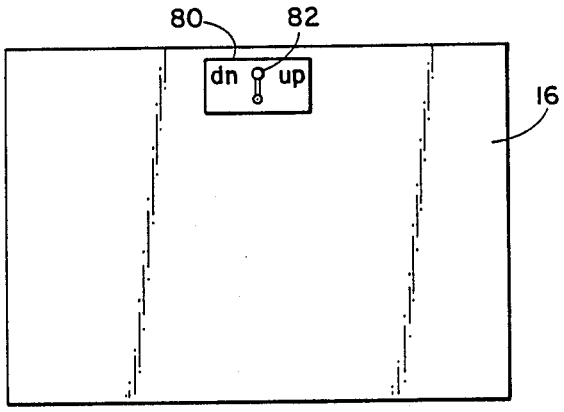
FIG. 5 is a rear view of the pallet lift apparatus of FIG. 1.

Referring also to FIG. 5, the rear wall 16 of the enclosure 10 includes a recess 80 which houses a center-off spring loaded toggle switch 82. When the switch is held in the up position the "A" solenoid of three position switch 64 is actuated and motor 58 is turned on. The pump 60 provides two gallons of fluid per minute to the flow divider 70 which in turn provides fluid at a rate of one gallon per minute to cylinders 48 and 72, respectively. This causes pistons 50 and 74 to extend thereby raising the carriage bar 28. When the switch 82 is held in the down position the "b" solenoid is activated which allows the cylinders 48 and 72, respectively, to vent through pressure relief valves 76 and 78 to the reservoir 68. The motor 58 is not used at this time since the weight of the lift cradle 18 and carriage bar 28 is enough to cause pressure valves 76 and 78 to engage. Thus, the pallet may be raised or lowered to whatever height is convenient for the worker, given the task at hand.

Other equivalent forms of a lift cradle may be employed if desired. For example, a slip sheet or platen could be used in place of lift cradle 18. Such a support could handle smaller pallets although requiring more material for fabrication. The platen would be suspended from hangers 20*a*, 20*b*, 26*a* and 26*b* in the same manner as lift cradle 18.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A lift apparatus for pallets to facilitate the loading and unloading thereof comprising:

(a) a U-shaped enclosure having a rear wall portion and two adjacent sidewall portions;

(b) selectively movable lift cradle means situated within said enclosure for holding a loading platform; and (c) lift actuating means located within and extending through an elongated aperture in each of said sidewall enclosure portions for selectively moving said lift cradle means up or down whereby said loading platform may be positioned at a convenient height for loading and unloading; (d) stop means comprising a plurality of pins insertable into apertures in an inner wall of said enclosure, for acting between said inner wall and said lift cradle means for retaining said lift cradle means at a predetermined height, whereby said apparatus may be raised by exerting upward pressure from underneath said lift cradle means.

2. The lift apparatus of claim 1 wherein said lift cradle means includes an angle bracket extending along at least said two adjacent sidewall portions of said enclosure.

3. The lift apparatus of claim 2 wherein said angle bracket extends about the inner periphery of said enclosure.

4. The lift apparatus of claim 1 wherein said enclosure includes an inner wall and an outer wall and said lift actuating means comprises a pair of scissor arm means coupled to said lift cradle means and disposed between said inner and outer walls.

5. The lift apparatus of claim 4 wherein each of said scissor arm means is driven by hydraulic piston and cylinder means.

6. The lift apparatus of claim 1 further including switch means for engaging said lift actuating means to cause said lift cradle means to move continuously up or down until said switch means is released.

7. The lift apparatus of claim 6 wherein said switch means comprises a center-off spring loaded toggle switch.

8. The lift apparatus of claim 3 wherein said angle bracket is suspended from hangers attached to a carriage bar so as to permit said angle bracket to rest directly on the floor when fully lowered.

* * * * *

UNITED STATES PATENT AND TRADEMARK OFFICE

CERTIFICATE OF CORRECTION

PATENT NO. : 4,741,414

DATED : May 3, 1988

INVENTOR(S) : Robert D. Claassen

It is certified that error appears in the above-identified patent and that said Letters Patent is hereby corrected as shown below:

Col. 3, Line 48 Change "bangers" to --hangers--.

Signed and Sealed this

Twelfth Day of September, 1989

*Attest:*

DONALD J. QUIGG

*Attesting Officer*

*Commissioner of Patents and Trademarks*